US007572211B2

(12) United States Patent
Roach

(10) Patent No.: US 7,572,211 B2
(45) Date of Patent: Aug. 11, 2009

(54) ROWING SIMULATION MACHINE

(76) Inventor: Matthew Duncan Roach, 38 Chesterfield Parade, Bronte NSW 2024 (AU)

( * ) Notice: Subject to any disclaimer, the term of this patent is extended or adjusted under 35 U.S.C. 154(b) by 46 days.

(21) Appl. No.: 10/572,037

(22) PCT Filed: Sep. 15, 2004

(86) PCT No.: PCT/AU2004/001252

§ 371 (c)(1),
(2), (4) Date: Jan. 3, 2007

(87) PCT Pub. No.: WO2005/025685

PCT Pub. Date: Mar. 24, 2005

(65) Prior Publication Data

US 2007/0197347 A1 Aug. 23, 2007

(30) Foreign Application Priority Data

Sep. 15, 2003 (AU) ..... 2003905050

(51) Int. Cl.
*A63B 69/06* (2006.01)
*A63B 71/00* (2006.01)

(52) U.S. Cl. ..... 482/72; 482/51

(58) Field of Classification Search ..... 482/72–73, 482/51–53, 120, 74
See application file for complete search history.

(56) References Cited

U.S. PATENT DOCUMENTS 1,111,269 A * 9/1914 Medart ..... 482/72
3,473,843 A * 10/1969 Reginald ..... 297/130
3,528,653 A * 9/1970 Ross et al. ..... 482/72
4,563,000 A * 1/1986 Gall ..... 482/72
4,743,011 A * 5/1988 Coffey ..... 482/73
4,953,415 A 9/1990 Lehtonen
5,013,033 A * 5/1991 Watterson et al. ..... 482/72
5,076,573 A 12/1991 Lo
5,092,581 A * 3/1992 Koz ..... 482/72
5,441,469 A * 8/1995 Chern ..... 482/72
5,779,600 A * 7/1998 Pape ..... 482/72
7,022,052 B1 * 4/2006 Lai ..... 482/72

FOREIGN PATENT DOCUMENTS

EP 380292 8/1990
WO WO 88/08735 11/1988
WO WO 92/00780 1/1992

* cited by examiner

*Primary Examiner*—Fenn C Mathew
(74) *Attorney, Agent, or Firm*—D. Peter Hochberg; Sean F. Mellino; Daniel J. Smola

(57) ABSTRACT

A rowing machine on which a user simulates a rowing or sculling motion. The machine imparts a resistance to the rowing or sculling motion. The machine comprises a substantially horizontal frame having a fore end and an aft end, a seat moveably mounted on the frame, foot rest means for positioning the user's feet, a flywheel, a pair of outriggers mounted to the frame and extending laterally from said frame. Each outrigger is adapted to pivotally support a rowing oar at or near its free end. Each oar is connected to the flywheel via a drive assembly. The flywheel is mounted at or near the fore end of said frame and said flywheel has an axis of rotation that is disposed substantially vertically.

14 Claims, 4 Drawing Sheets

ROWING SIMULATION MACHINE

CROSS-REFERENCE TO RELATED APPLICATION

This application is a national phase application of International Application No. PCT/AU2004/001252 filed on Sep. 15, 2004, and claims priority of Australian provisional patent application Ser. No. 2003905050 filed Sep. 15, 2003.

BACKGROUND OF THE INVENTION

1. Field of the Invention

The present invention relates to rowing machines and in particular to a rowing simulation machine.

2. Description of the Prior Art

Rowing machines are well-known for the purposes of building up general fitness and/or for training specifically for rowing and related sports. Rowing machines allow the user to exercise both upper body and lower body strength by simulating roughly the movement required to propel a rowboat through the water.

There is a variety of prior art rowing machines including a rowing simulator disclosed in U.S. Pat. No. 5,779,600 (Pape) utilizing a flywheel that is driven by a pair of oars. U.S. Pat. No. 4,743,011 (Coffey) discloses a rowing machine that uses a flywheel as a resistance member, and has cam sector arms that are pivoted to rotate with the machine's oars. The arcuate shape of the cam sector arms provide a constant resistance force to the stroke of the oars over the oar sweep. U.S. Pat. No. 5,092,581 (Koz) discloses a rowing exercise machine providing a limited degree of free lateral rotation to aid in simulating the rock of a real rowboat. It uses a gyroscopic flywheel system to provide resistance and a limited level of lateral stability.

These prior art rowing machines present a number of disadvantages including the complexity of their designs. Complex mechanisms often involve a high level of maintenance and a high purchase price. Another disadvantage of U.S. Pat. No. 4,743,011 (Coffey), is that the machine presents danger to the user, and others in the vicinity of the machine, by virtue of the swinging cam sector arms. Yet another disadvantage of the prior art is the large amount of space these machines occupy and the subsequent difficulty associated with their transportation and handling within gymnasiums and rowing sheds.

The present invention seeks to provide a rowing simulation machine that will overcome or substantially ameliorate at least some of the deficiencies of the prior art, or to at least provide an alternative.

SUMMARY OF THE INVENTION

According to a first aspect of the invention there is provided a rowing machine on which a user simulates a rowing or sculling motion, said machine imparting a resistance to the rowing or sculling motion, said machine comprising a substantially horizontal frame having a fore end and an aft end, a seat moveably mounted on said frame, foot rest means for positioning the user's feet, a flywheel, a pair of outriggers mounted to said frame and extending laterally from said frame, each said outrigger adapted to pivotally support a rowing oar at or near its free end, each of said oars being operably connected to said flywheel via a drive assembly, characterized in that said flywheel is mounted at or near the fore end of said frame and said flywheel has an axis of rotation that is disposed substantially vertically.

Preferably, said drive assembly includes a plurality of spindles and engagement members, each having an axis of rotation substantially parallel to the axis of rotation of said flywheel, and wherein said oars drive said flywheel via said spindles.

Preferably, said frame also comprises a pair of arms that are pivotally mounted to said fore end of said frame.

Preferably, at least some of said drive assembly is mounted on said pair of arms.

Preferably, said drive assembly includes a first linkage means interconnecting said oars and said engagement members via said spindles.

Preferably, said first linkage means is at least one flexible strap.

Preferably, said drive assembly includes a second linkage means interconnecting said engagement members and said flywheel.

Preferably, said second linkage means is a chain means and said engagement members are sprockets with an integral one-way clutch.

Preferably, said pair of arms are removably mounted to said fore end of said frame.

Preferably, said pair of outriggers are pivotally mounted to said frame.

Preferably, said pair of outriggers are removably mounted to said frame.

Preferably, said outrigger removably supports said oars.

Preferably, the movement of said oars is mutually independent.

Preferably, a bias member returns said oars to a neutral position if released by said user.

Preferably, said bias member is connected to said arms and said spindles.

BRIEF DESCRIPTION OF THE DRAWINGS

A preferred embodiment of the invention will now be described, by way of example only, with reference to the accompanying drawings in which.

DETAILED DESCRIPTION OF THE PREFERRED EMBODIMENT

Figure 1:
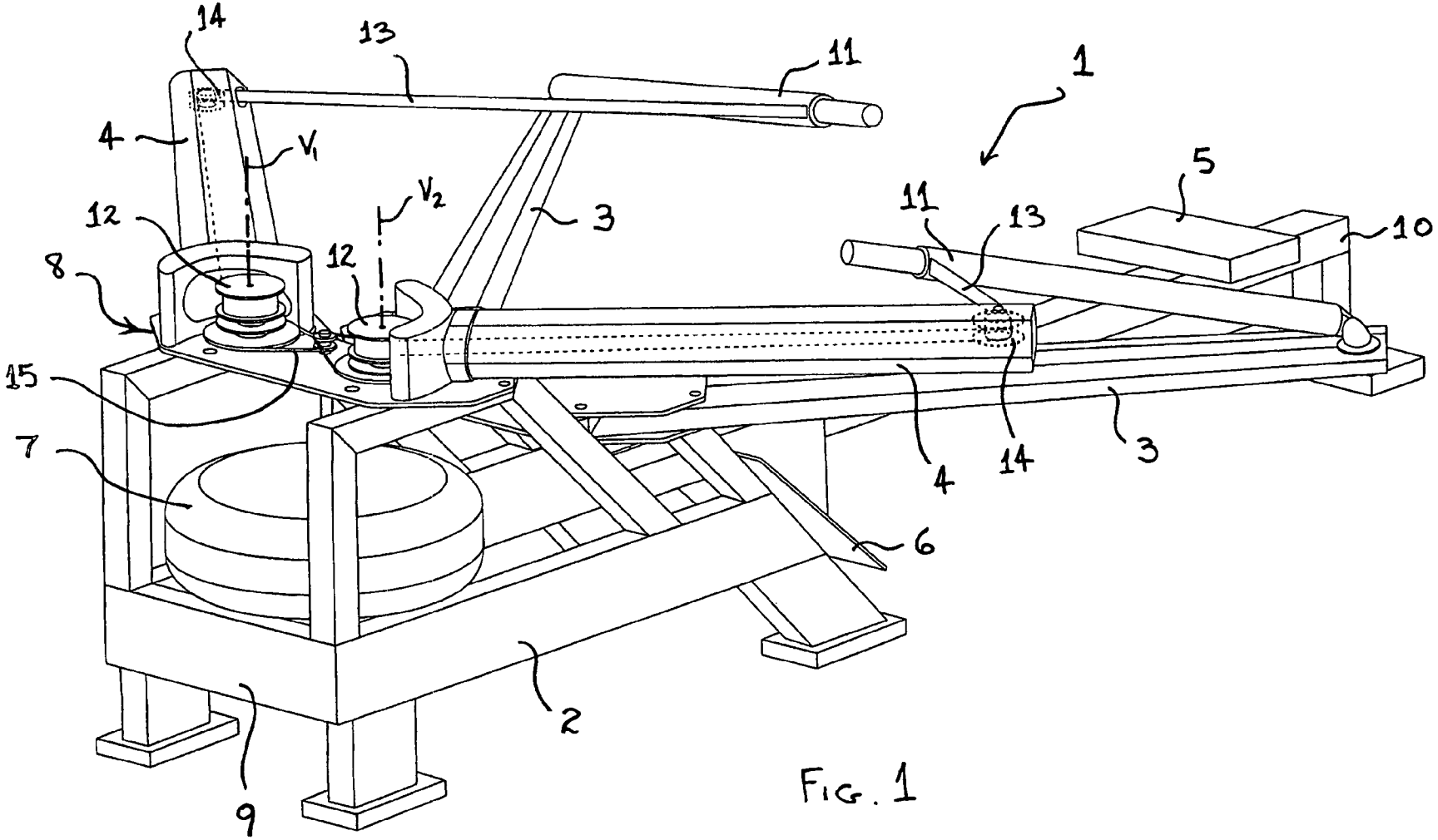
FIG. 1 is a perspective view of a rowing simulation machine according to a first preferred embodiment, with covers removed from the drive assembly.
Figure 2:
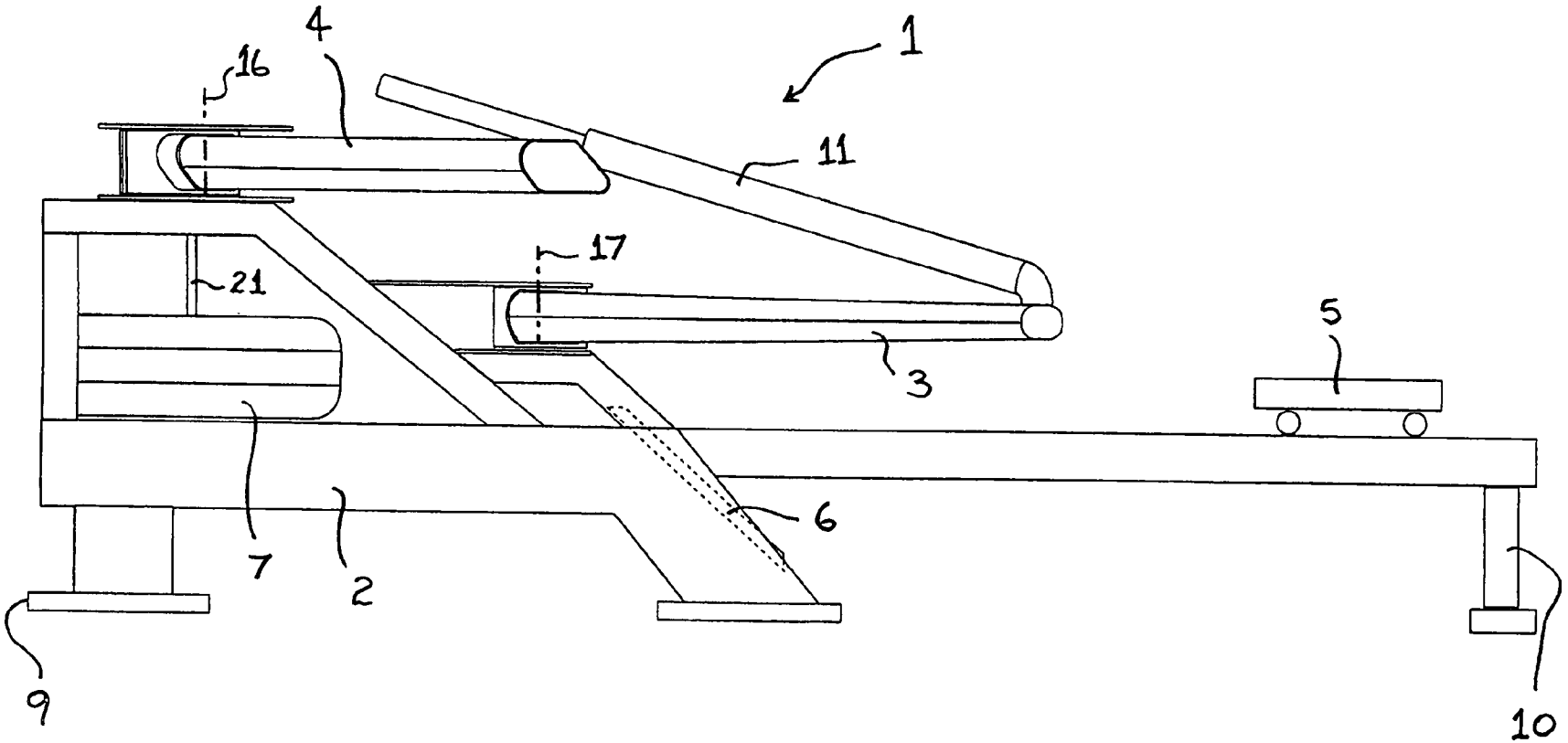
FIG. 2 is a side view of the rowing simulation machine of FIG. 1.

FIGS. 1 and 2 depict a rowing machine 1 on which a user simulates a rowing or sculling motion. The rowing machine 1 imparts a resistance to the rowing or sculling motion and comprises a frame 2, a pair of outriggers 3, a pair of arms 4, a seat 5, a pair of footrests 6, a flywheel 7 and a drive assembly 8. The frame 2 has a fore end 9 and an aft end 10. The arms 4 are mounted near the fore end 9 of the frame 2, in front of the outriggers 3, above the flywheel 7 and extending laterally away from the frame 2, at about 45 degrees to the longitudinal axis of the frame 2. The outriggers 3 are mounted intermediate the arms 4 and the aft end 10, although they are closer to the arms 4 than the aft end 10 and they extend laterally away from the frame 2. The seat 5 has wheels underneath it that enable it to slide along the aft side of the frame 2, which comprises a horizontally disposed elongate beam of rectangular cross-section. A user may sit on the seat 5 and push with his legs against the footrests 6 in order to generate the force required to pull a pair of oars 11 which are pivotally mounted to the free ends of the outriggers 3.

The oars 11 are connected to the flywheel 7 by a drive assembly 8. The flywheel 7 has a vertically disposed flywheel axle 21 (shown in FIG. 2) and includes vanes and a cover that provide air resistance. The cover can be adjusted to vary the level of air resistance. Each oar 11 is connected to a respective frame spindle 12 (omitted from FIG. 2) mounted on the frame 2. The frame spindles 12 have vertical axes of rotation $V_1$ and $V_2$ respectively which are parallel to the vertical flywheel axle 21 (shown in FIG. 2). The connection is by means of a strap 13 made from webbing, which also passes around a respective arm spindle 14 (omitted from FIG. 2), mounted on the respective arm 4. As a result of the orientation of arms 4, this arrangement means that the resistance force generated by the flywheel 7 and transmitted to oars 11 via strap 13, has a realistic feel to it. The frame spindles 12 each include a sprocket arrangement (not shown) that allows them to be rotationally connected to the vertical flywheel axle 21 which also includes a sprocket arrangement (not shown) via a chain 15. The latter sprocket arrangement includes a one-way clutch. Thus, translation of the oars 11 is achieved by the user by pushing with his legs against the footrest 6 and pulling the oars 11 with his/her arms and results in rotation of the flywheel 7.

An elastic cord (not shown) wraps around the frame spindles 12 and connects them to the arms 4. The cord aids in returning the oars 11 to a neutral position when released.

The above embodiment is relatively simple in nature in contrast to the complex nature of the prior art designs. This is achieved by virtue of the vertical alignment of the axis of rotation of the flywheel 7 and spindles 12 and 14. Another advantage of the present invention is that since it is relatively simplistic, it minimizes risk to the user. This is in stark contrast to the prior art, such as U.S. Pat. No. 4,743,011 (Coffey), which has a pair of dangerous swinging cam sectors. The position of the outriggers 3 also allows for easy mounting and dismounting from the machine 1.

Figure 3:
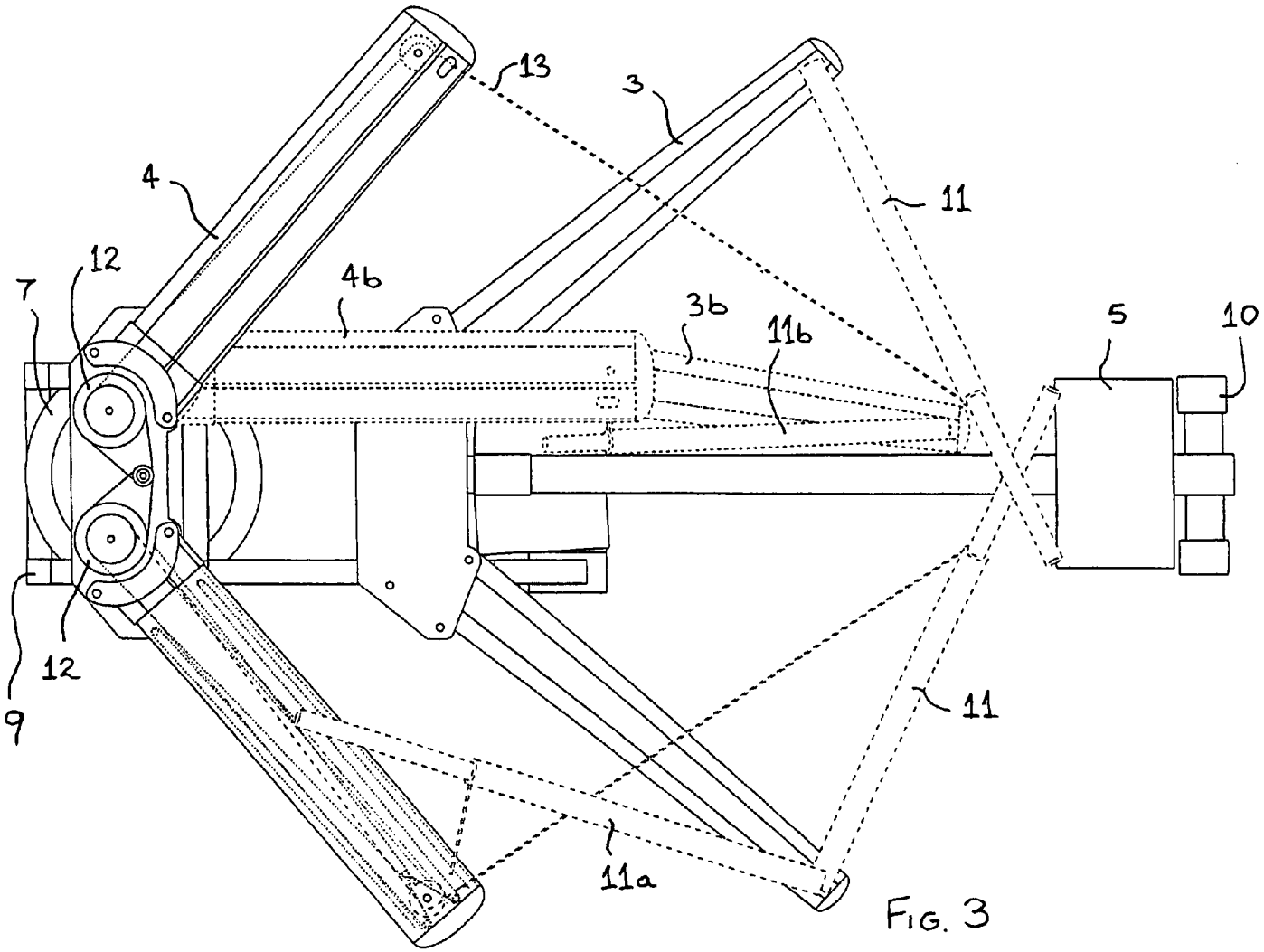
FIG. 3 is a plan view of the rowing simulation machine of FIG. 1 showing the oars in two positions representative of the limits of a single stroke cycle.

The outriggers 3 and arms 4 may be rotated about arm pivot points 16 and outrigger pivot points 17, respectively for storage purposes. In FIG. 3, one of the outriggers 3, arms 4, and oars 11 are shown by dotted lines 3*b*, 4*b*, and 11*b* in their stowed position. Also, one of the oars 11 shown at the end of the stroke, is also shown as 11*a* at the beginning of the stroke. The machine can be used for both sweep oar training (one oar) and sculling training (two oars), by reconfiguring the oars 11. To this end, the drive assembly 8 allows both oars 11 to be moved independently. The length of the oars 11 and the set-up of the foot rest 6 can be adjusted to suit the individual user.

Figure 4:
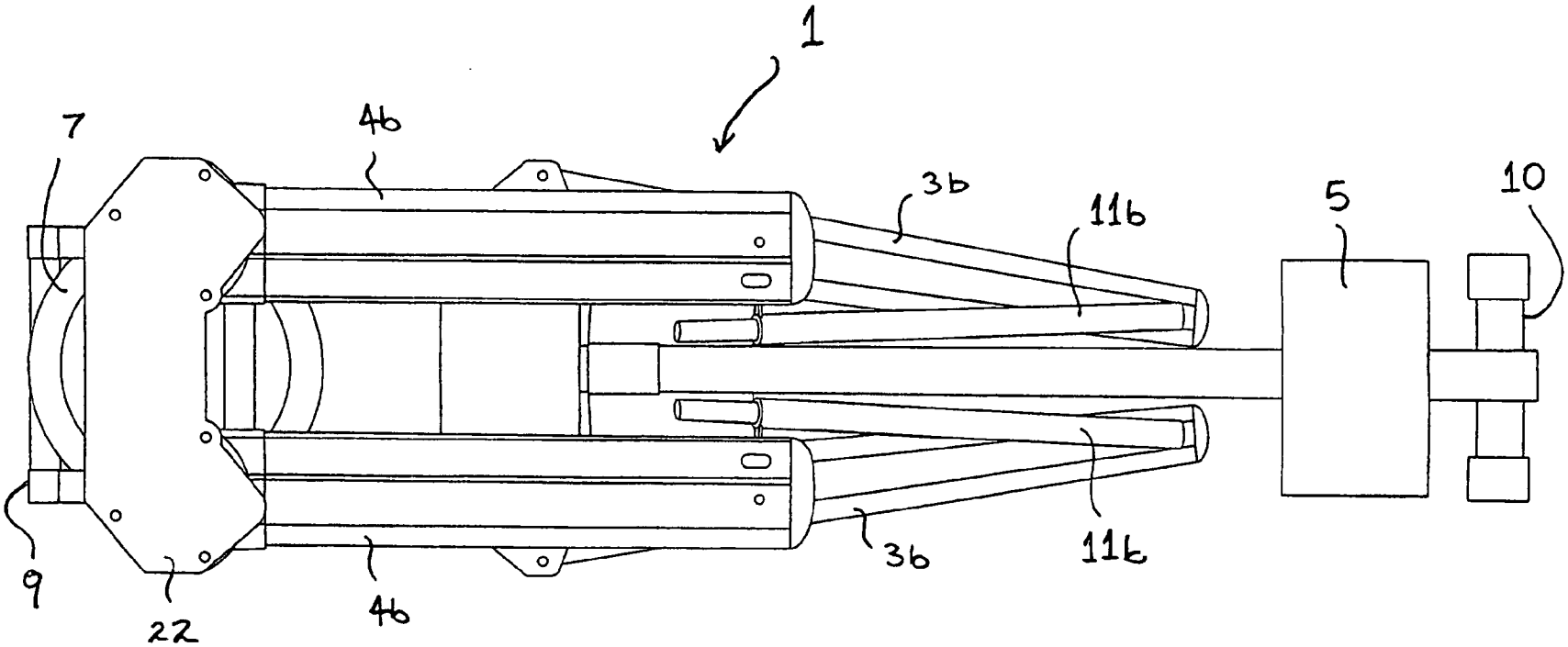
FIG. 4 is a schematic view of the rowing simulation machine of FIG. 1 in a stowed position and with drive assembly covers in place.

FIG. 4 depicts the rowing machine 1 with covers 22 in a stowed position, in which the arms and outriggers have been pivoted back around the arm pivot points 16 and the outrigger pivot points 17 respectively into their stowed positions. The oars have been pivoted forwards into a position intermediate the pair of arms 4. In this stowed configuration the arms, outriggers and oars are depicted by numerals 4*b*, 3*b* and 11*b* respectively.

The frame 2, outriggers 3 and arms 4 are made from steel extrusions in this embodiment, however any other suitable engineering materials such as aluminium or carbon fibre can be used. The oars 11 are made from carbon fibre composite in this embodiment, however any other suitable engineering materials such as wood or aluminium can be used. The frame spindles 12, arm spindles 14 and flywheel axle 21 are made from steel in this embodiment, however any other suitable engineering materials can be used. The rowing machine 1 also includes a computer and display monitor (not shown) that provides the user with exercise and rowing simulation related information.

It should be understood that whilst in the present embodiment the flywheel 7 is of an air-vent type, it may in other embodiments be of a magnetic or water type flywheel.

The foregoing describes only a preferred embodiment of the present invention and modifications, obvious to those skilled in the art, can be made thereto without departing from the scope of the present invention.

The term "comprising" (and its grammatical variations) as used herein is used in the inclusive sense of "having" or "including" and not in the exclusive sense of "consisting only of".

The claims defining the invention are as follows:

1. A rowing machine on which a user simulates a rowing or sculling motion, said machine imparting a resistance to the rowing or sculling motion, said machine comprising a substantially horizontal frame having a fore end and an aft end, a seat moveably mounted on said frame, foot rest apparatus for positioning the user's feet, a flywheel, and a pair of outriggers mounted to said frame and extending laterally from said frame, each said outrigger pivotally supporting a rowing oar at or near its free end, each of said oars being operably connected to said flywheel via a drive assembly, said flywheel being mounted at or near the fore end of said frame and having an axis of rotation disposed substantially vertically;

wherein said drive assembly includes a plurality of spindles and engagement members, each of said plurality of spindles and engagement members having an axis of rotation substantially parallel to the axis of rotation of said flywheel, and wherein said oars drive said flywheel via said spindles.

2. A rowing machine as claimed in claim 1, wherein said frame also comprises a pair of arms pivotally mounted to said fore end of said frame.

3. A rowing machine as claimed in claim 2, wherein at least some of said drive assembly is mounted on said pair of arms.

4. A rowing machine as claimed in claim 3, wherein said drive assembly includes a first linkage device interconnecting said oars and said engagement members via said spindles.

5. A rowing machine as claimed in claim 4, wherein said first linkage device is at least one flexible strap.

6. A rowing machine as claimed in claim 3, wherein said drive assembly includes a second linkage device interconnecting said engagement members and said flywheel.

7. A rowing machine as claimed in claim 6, wherein said second linkage device is a chain structure and said engagement members are sprockets with an integral one-way clutch.

8. A rowing machine as claimed in claim 2, wherein said pair of arms are removably mounted to said fore end of said frame.

9. A rowing machine as claimed in claim 1, wherein said pair of outriggers are pivotally mounted to said frame.

10. A rowing machine as claimed in claim 1, wherein said pair of outriggers are removably mounted to said frame.

11. A rowing machine as claimed in claim 1, wherein said pair of outriggers removably supports said oars.

12. A rowing machine as claimed in claim 1, wherein the movement of said oars is mutually independent.

13. A rowing machine as claimed in claim 1, wherein a bias member returns said oars to a neutral position if released by said user.

14. A rowing machine as claimed in claim 13, wherein said bias member is connected to said arms and said spindles.

* * * * *